US009175672B2

(12) United States Patent
Ohno et al.

(10) Patent No.: US 9,175,672 B2
(45) Date of Patent: Nov. 3, 2015

(54) VALVE PLATE AND AXIAL PISTON HYDRAULIC PUMP MOTOR INCLUDING THE SAME

(75) Inventors: Takeshi Ohno, Kobe (JP); Mariko Ohno, legal representative, Kobe (JP); Makoto Azuma, Kakogawa (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 436 days.

(21) Appl. No.: 13/582,310

(22) PCT Filed: Feb. 24, 2011

(86) PCT No.: PCT/JP2011/001060

§ 371 (c)(1), (2), (4) Date: Aug. 31, 2012

(87) PCT Pub. No.: WO2011/121883

PCT Pub. Date: Oct. 6, 2011

(65) Prior Publication Data

US 2013/0055888 A1 Mar. 7, 2013

(30) Foreign Application Priority Data

Mar. 31, 2010 (JP) ..... 2010-080588

(51) Int. Cl.
*F04B 1/20* (2006.01)
*F01B 3/00* (2006.01)

(52) U.S. Cl.
CPC ..... *F04B 1/2021* (2013.01); *F01B 3/0047* (2013.01)

(58) Field of Classification Search
CPC ..... F04B 1/122; F04B 1/2057; F04B 1/2021; F01B 3/0047; F01B 3/0055
USPC ..... 417/269, 531; 91/499; 137/340
See application file for complete search history.

(56) References Cited

U.S. PATENT DOCUMENTS 5,105,723 A * 4/1992 Kazahaya et al. ..... 91/485
5,253,983 A * 10/1993 Suzuki et al. ..... 417/485

FOREIGN PATENT DOCUMENTS

GB 2 056 576 A 3/1981
JP Y1-41-019713 9/1966
JP B1-46-007854 2/1971

(Continued)

OTHER PUBLICATIONS

JP-2002-39047_English_Translation_Abstract (Kiminori et al.) Feb. 6, 2002.*

(Continued)

*Primary Examiner* — Charles Freay
*Assistant Examiner* — Kenneth J Hansen
(74) *Attorney, Agent, or Firm* — Oliff PLC

(57) ABSTRACT

A valve plate is used in a swash plate type motor including a motor shaft and a cylinder block in a motor housing and includes: a sliding supporting surface contacting a rear end surface of the cylinder block to support the cylinder block; a supporting surface that is a surface corresponding to and opposite to the sliding supporting surface; a central through hole through which the motor shaft penetrates; and a plurality of ports and formed around the central through hole as inlets and outlets of operating oil so as to penetrate the valve plate, and a cooling concave portion into which the operating oil flows is formed in a region except for the ports and on the supporting surface.

4 Claims, 6 Drawing Sheets

(56) References Cited

FOREIGN PATENT DOCUMENTS

| | | | | |
|---|---|---|---|---|
| JP | B1-47-033083 | | 8/1972 | |
| JP | A-52-036303 | | 3/1977 | |
| JP | A-56-032080 | | 4/1981 | |
| JP | A-04-219473 | | 8/1992 | |
| JP | U-07-022076 | | 4/1995 | |
| JP | A-11-022654 | | 1/1999 | |
| JP | A-11-241674 | | 9/1999 | |
| JP | 2002039047 A | * | 2/2002 | ..... F03C 1/06 |
| JP | A-2002-039047 | | 2/2002 | |
| JP | A-2002-098034 | | 4/2002 | |
| JP | A-2002-349423 | | 12/2002 | |
| JP | A-2003-003949 | | 1/2003 | |

OTHER PUBLICATIONS

13582310_Jan. 13, 2015_JP_2002039047_A_I_Translation, Hasagawa, Feb. 2002.*

International Search Report issued in International Application No. PCT/JP2011/001060 dated May 17, 2011.

* cited by examiner

VALVE PLATE AND AXIAL PISTON HYDRAULIC PUMP MOTOR INCLUDING THE SAME

TECHNICAL FIELD

The present invention relates to a valve plate, an axial piston hydraulic pump including the valve plate, and an axial piston hydraulic motor including the valve plate.

BACKGROUND ART

Known as examples of a hydraulic pump and a hydraulic motor are an axial piston hydraulic pump and an axial piston hydraulic motor. Examples of the axial piston hydraulic pump are a swash plate type hydraulic pump and a bent axis type hydraulic pump. Examples of the axial piston hydraulic motor are a swash plate type hydraulic motor and a bent axis type hydraulic motor. For example, a pump disclosed in PTL 1 is known as a swash plate type hydraulic pump (hereinafter may be simply referred to as a "swash plate type pump"). Moreover, for example, a motor disclosed in PTL 2 is known as a swash plate type hydraulic motor (hereinafter may be simply referred to as a "swash plate type motor"). Further, for example, a pump motor disclosed in PTL 3 is known as a bent axis type hydraulic pump motor.

Each of these pumps and motors include a valve plate. The configurations of the pump and motor are basically the same as each other except that: in the pump, a cylinder block is rotated by the rotation of a driving shaft; and in the motor, a motor shaft is rotated by the rotation of a cylinder block. The valve plate will be explained using the swash plate type pump of PTL 1 as an example.

FIG. 11 shows a swash plate type pump 61 of PTL 1. A cylinder block 64 fixed to a driving shaft 63 and capable of rotating together with the driving shaft 63 is included in a pump housing 62 of the swash plate type pump 61. A rear end surface of the cylinder block 64 contacts a valve plate 65 to be supported by the valve plate 65. A plurality of cylinders 66 are formed on the cylinder block 64 so as to be located around the driving shaft 63 and be parallel to one another. Pistons 67 are respectively inserted in the cylinders 66. Tip end portions of the pistons 67 are respectively coupled to shoes 67*a*. The shoes 67*a* are rotatable together with the cylinder block 64 and the pistons 67 and are slidable with respect to a shoe plate 68 fixed to a swash plate 69.

When the driving shaft 63 is rotated by a driving device, not shown, the cylinder block 64 also rotates, and the pistons 67 reciprocate in the cylinders 66 by a reaction from the swash plate 69. The rear end surface of the cylinder block 64 is pressed against the valve plate 65 by the action of internal pressure of the cylinders 66. Since the cylinder block 64 rotates in this state, frictional heat is generated on sliding surfaces of the valve plate 65 and the cylinder block 64. Generally, while sealing the operating oil by the sliding surfaces, lubrication and cooling are also performed by an appropriate amount of drain oil (leakage oil). Thus, thermal balance is maintained. However, the seizure of the sliding surfaces or the thermal crack of the valve plate 65 may occur due to the increase in the internal pressure of the cylinders 66 or the increase in the rotation speed of the cylinder block 64. If the amount of leakage oil is increased for the purpose of increasing the cooling effect, the efficiency of the pump or the motor decreases, The same problem as above occurs in the bent axis type pump using the valve plate. Further, the swash plate type motor and the bent axis type motor, each basically having the same configuration as the hydraulic pump, cannot avoid the same problem as above.

CITATION LIST

Patent Literature

PTL 1: Japanese Laid-Open Patent Application Publication No. 2003-003949

PTL 2: Japanese Laid-Open Patent Application Publication No. 11-022654

PTL 3: Japanese Laid-Open Patent Application Publication No. 2002-349423

SUMMARY OF INVENTION

Technical Problem

The present invention was made to solve the above problems, and an object of the present invention is to provide a valve plate capable of significantly suppressing the increase in the temperature of the valve plate that is operating, without depending on the adjustment of the amount of leakage oil by hydraulic balance of the sliding surfaces, and to provide an axial piston hydraulic pump using this valve plate and an axial piston hydraulic motor using this valve plate.

Solution to Problem

A valve plate of the present invention is a valve plate used in an axial piston hydraulic device including a rotating shaft and a rotary cylinder block in a housing, the valve plate including: a sliding supporting surface configured to contact a rear end surface of the cylinder block to support the cylinder block; a back surface that is a surface corresponding to and opposite to the sliding supporting surface; a central hole through which the rotating shaft penetrates; and a plurality of ports formed around the central hole as inlets and outlets of operating oil so as to penetrate the valve plate, wherein a cooling concave portion into which the operating oil flows is formed in a region except for the ports on the back surface.

According to the valve plate, the operating oil flowing into the cooling concave portion on the back surface serves as a cooling medium and recovers the frictional heat generated by the sliding of the valve plate with respect to the cylinder block. Thus, the cooling effect of the valve plate is obtained. The temperature of the sliding surface locally becomes higher than the temperature of the drain oil in the housing. Therefore, the cooling effect can be obtained by using as the operating oil which serves as the cooling medium, the drain oil in the housing or the oil flowing through the suction port or the ejection port.

In the valve plate in which the ports are formed on both left and right sides of the central hole, the cooling concave portion may be formed at at least one of upper and lower sides, where the ports are not formed, of the central hole, and a bottom portion of the concave portion may form the sliding supporting surface. With this, the portion from which the frictional heat is less likely to dissipate since the ports are not formed can be effectively cooled.

A groove through which the operating oil flows and which causes the cooling concave portion to communicate with at least one of the central hole located on an inner side of the valve plate and an inner space of the housing located on an outer side of the valve plate may be formed on the back surface. With this, since the operating oil flows between the concave portion and the central hole located on the inner side of the valve plate and/or between the concave portion and the inner space of the housing located on the outer side of the valve plate, the improvement of the cooling effect can be expected.

The cooling concave portion may be constituted by a groove configured on the back surface to cause the central hole located on an inner side of the valve plate and an inner space of the housing located on an outer side of the valve plate to communicate with each other. With this, the above-described flow of the operating oil becomes smooth, and the improvement of the cooling effect can be expected.

In a case where the valve plate is a valve plate used in the axial piston hydraulic pump, a groove through which the operating oil flows and which causes the cooling concave portion to communicate with an operating oil suction port among the ports may be formed on the back surface. With this, since a large amount of operating oil flows through the concave portion, the cooling effect of the valve plate improves. The groove may be the concave portion itself. To be specific, the concave portion may be formed to communicate with the operating oil suction port.

In a case where the valve plate is a valve plate used in the axial piston hydraulic motor, an operating oil supply passage configured to communicate with an operating oil discharge port among the ports may be connected to the cooling concave portion. With this, since the operating oil for cooling is aggressively supplied from the discharge port to the concave portion, the cooling effect improves.

A hydraulic pump of the present invention is an axial piston hydraulic pump including a valve plate, wherein: the valve plate is any one of the above valve plates; the rotating shaft is a driving shaft configured to cause the cylinder block to rotate; and the plurality of ports are suction ports and ejection ports of the operating oil.

A hydraulic motor of the present invention is an axial piston hydraulic motor including a valve plate, wherein: the valve plate is any one of the above valve plates; the rotating shaft is a motor shaft configured to be rotated by rotation of the cylinder block; and the plurality of ports are supply ports and discharge ports of the operating oil, the supply ports and the discharge ports being alternately switched by switching a rotational direction of the motor.

Advantageous Effects of Invention

According to the present invention, the operating oil flowing into the cooling concave portion on the back surface of the valve plate serves as the cooling medium and recovers the frictional heat generated by the sliding of the valve plate with respect to the cylinder block without depending on the adjustment of the amount of leakage oil. With this, the valve plate is effectively cooled. Therefore, the revolution of the cylinder block can be increased and the oil pressure can be increased without causing failures, such as seizure on the sliding surface of the valve plate with respect to the cylinder block.

DESCRIPTION OF EMBODIMENTS

Embodiments of a valve plate of the present invention, an axial piston hydraulic motor including this valve plate, and an axial piston hydraulic pump including this valve plate will be explained in reference to the attached drawings.

Figure 1:
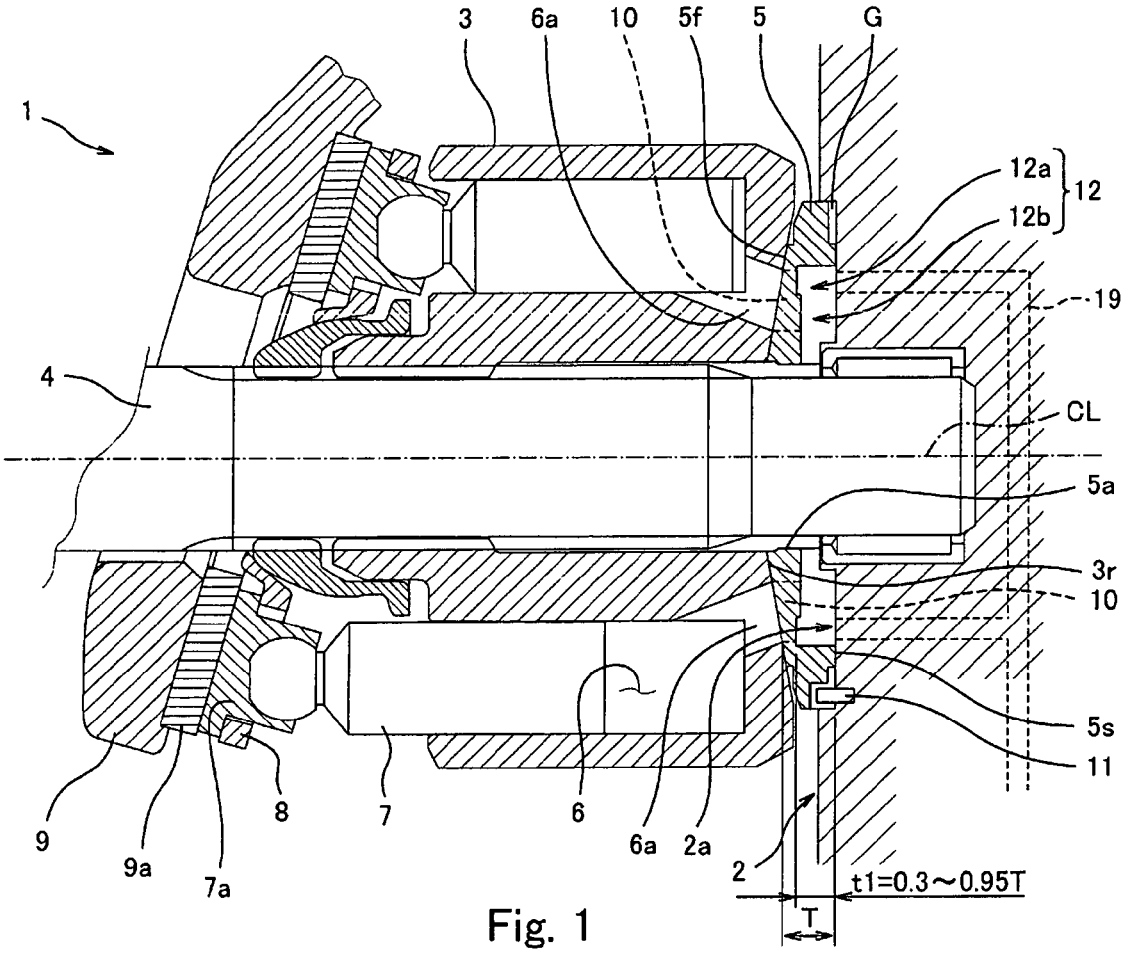
FIG. 1 is a longitudinal sectional view showing major portions of a swash plate type axial piston hydraulic motor including a valve plate according to a reference technical example for explaining one embodiment.

FIG. 1 shows major portions of an axial piston hydraulic motor (hereinafter referred to as a "swash plate type motor") of one embodiment of the present invention. A cylinder block 3 is included in a motor housing 2 of a swash plate type motor 1. A motor shaft 4 that is an output shaft is fixed to the cylinder block 3 along a central axis CL of the cylinder block 3. When the cylinder block 3 is rotated around the central axis CL, the motor shaft 4 also rotates. A rear end surface 3*r* of the cylinder block 3 contacts a front surface 5*f* of a valve plate 5 to be supported by the front surface 5*f* of the valve plate 5. Therefore, this front surface is also called a sliding supporting surface 5*f*. Since a central through hole 5*a* through which the motor shaft 4 penetrates is formed on a center portion of the valve plate 5, the entire valve plate 5 has an annular shape (see FIG. 2). The valve plate 5 is supported such that a rear end portion thereof fits in a circular fit concave portion 2*a* formed on an inner wall surface of the motor housing 2. An outer periphery of a surface (back surface) of the rear end portion of the valve plate 5 is shallowly cut out, so that a gap G is formed between the valve plate 5 and the surface of the motor housing 2. The hydraulic balance on the back surface of the valve plate 5 is set by the area of a surface (hereinafter referred to as a "supporting surface 5*s*") of the back surface, the surface contacting the surface of the motor housing 2. A whirl-stop pin 11 for preventing the rotation of the valve plate 5 is put in the inner wall surface of the motor housing 2.

A plurality of cylinders 6 are formed on the cylinder block 3 so as to be located around the central through hole 5*a* and be parallel to one another. Pistons 7 are respectively inserted in the cylinders 6. Spherical portions of the pistons 7 are respectively coupled to shoes 7*a*. The shoes 7*a* are pressed by a retainer plate 8 against a shoe plate 9*a* fixed to a swash plate 9. The shoes 7*a* are rotatable together with the cylinder block 3 and the pistons 7 and are slidable with respect to the swash plate 9 and the shoe plate 9*a*. Ports 6*a* through which the operating oil is supplied to and discharged from the cylinders 6 are respectively formed on bottom portions of the cylinders 6 of the cylinder block 3.

Figure 2:
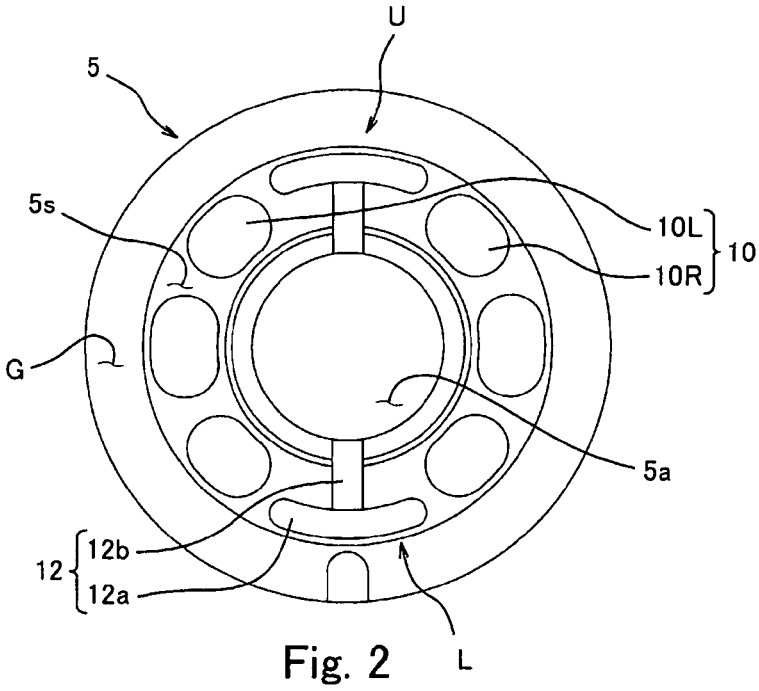
FIG. 2 is a diagram showing a back surface of the valve plate incorporated in the axial piston hydraulic motor of FIG. 1.

As is clear from FIGS. 1 and 2, a plurality of ports 10 are formed so as to penetrate the valve plate 5 and respectively communicate with the ports 6*a* of the cylinder block 3. In the valve plate 5 shown in FIG. 2, three left ports 10L and three right ports 10R are formed between an upper dead center U and lower dead center L of the valve plate 5 so as to be arranged along a circumferential direction. Here, the number of ports is not limited to three. In a case where the left ports 10L are oil supply ports and the right ports 10R are oil discharge ports, the cylinder block 3 rotates in a counterclockwise direction when viewed from a rear side (the valve plate 5 side) of the cylinder block 3. In a case where the left ports 10L are the oil discharge ports and the right ports 10R are the oil supply ports, the cylinder block 3 rotates in a clockwise direction. Of course, the pressure of the operating oil on the oil supply side is higher than that on the oil discharge side. An inner portion of the motor housing 2 is filled with the operating oil supplied to and discharged from the cylinders 6.

The rear end surface 3*r* of the cylinder block 3 is pressed against the sliding supporting surface 5*f* of the valve plate 5 by the pressure of the operating oil in the cylinders 6, and the cylinder block 3 rotates in this state. The sliding supporting surface 5*f* is a portion corresponding to the supporting surface 5*s* of the above-described back surface. As shown in FIGS. 1 and 2, groove-shaped concave portions 12 are respectively formed in the vicinity of the upper dead center U and lower dead center L on the supporting surface 5*s* of the valve plate 5. The concave portions 12 are formed for the purpose of cooling the valve plate 5 by the operating oil flowing into the concave portions 12. Each of the concave portions 12 is constituted by: a circular-arc groove 12*a* formed along an outer peripheral circle of the valve plate 5 in the vicinity of the outer periphery of the valve plate 5; and a radial groove 12*b* formed to cause the circular-arc groove 12*a* to communicate with the central through hole 5*a*.

As shown in FIG. 1, the relation between a depth t1 of the circular-arc groove 12*a* and a thickness T of a portion, where the groove 12*a* is formed, of the valve plate 5 is shown by a formula "t1=0.3 to 0.95T".

A surface on the cylinder block 3 side of a bottom portion of the concave portion 12 is formed to be included in the sliding supporting surface 5*f*.

When the swash plate type motor 1 is operating, the operating oil in low-pressure ports from the cylinders 6 flows through an operating oil supply passage 19 into the concave portion 12. Then, the operating oil flows out through the radial groove 12*b* to the central through hole 5*a*. Although the frictional heat is generated on the valve plate 5 by the sliding of the cylinder block 3, the valve plate 5 is cooled by the operating oil flowing into the concave portion 12. The thickness of the portion, where the concave portion 12 is formed, of the valve plate 5 is smaller than that of the other portion thereof. Therefore, the cooling effect is further effective. The reason why the circular-arc groove 12*a* is formed in the vicinity of the outer periphery of the valve plate 5 so as to be spaced apart from the central through hole 5*a* is as below. That is, since a relative rotating speed (circumferential speed) of an outer portion of the sliding supporting surface 5*f* with respect to the cylinder block 3 is higher and this increases the amount of frictional heat generated at the outer portion, the circular-arc groove 12*a* is formed as above for the purpose of effectively cooling the outer portion of the sliding supporting surface 5*f*.

Even if the operating oil supply passage 19 cannot be formed, the concave portion 12 is filled with the oil in the motor housing 2. Since the temperature of the oil in the housing 2 is lower than the temperature of the sliding surface, the cooling effect can be obtained.

In FIG. 1, the depth of the circular-arc groove 12*a* and the depth of the radial groove 12*b* are slightly different from each other. However, the present embodiment is not limited to this. These depths of the grooves may be the same as each other, or the radial groove 12*b* may be deeper than the circular-arc groove 12*a*.

FIGS. 3 to 8 show cooling concave portions 23, 24, 25, 26, 27, and 28 respectively formed on valve plates 13, 14, 15, 16, 17, and 18 and having different shapes from one another. The valve plates shown in FIGS. 2 to 8 are valve plates used in the swash plate type motor. These cooling concave portions 12 and 23 to 28 including the concave portion 12 of FIG. 2 are formed at the upper dead centers U and lower dead centers L of the valve plates 13 to 18. This is because since the ports 10 are not formed at the upper dead center U and the lower dead center L, the frictional heat is less likely to dissipate and the temperature tends to increase at the upper dead center U and the lower dead center L as compared to the other portions. Further, this is because at the upper dead center U and the lower dead center L, there is an adequate space for forming the concave portion. Therefore, the cooling effect can be obtained even in a case where the concave portion is formed at only one of the upper dead center U and the lower dead center L. If possible, the concave portion may be formed between the left ports 10L or between the right ports 10R, not at the upper dead center U and the lower dead center L. This is because the cooling effect can be obtained by forming the concave portion anywhere on the supporting surface.

Figure 3:
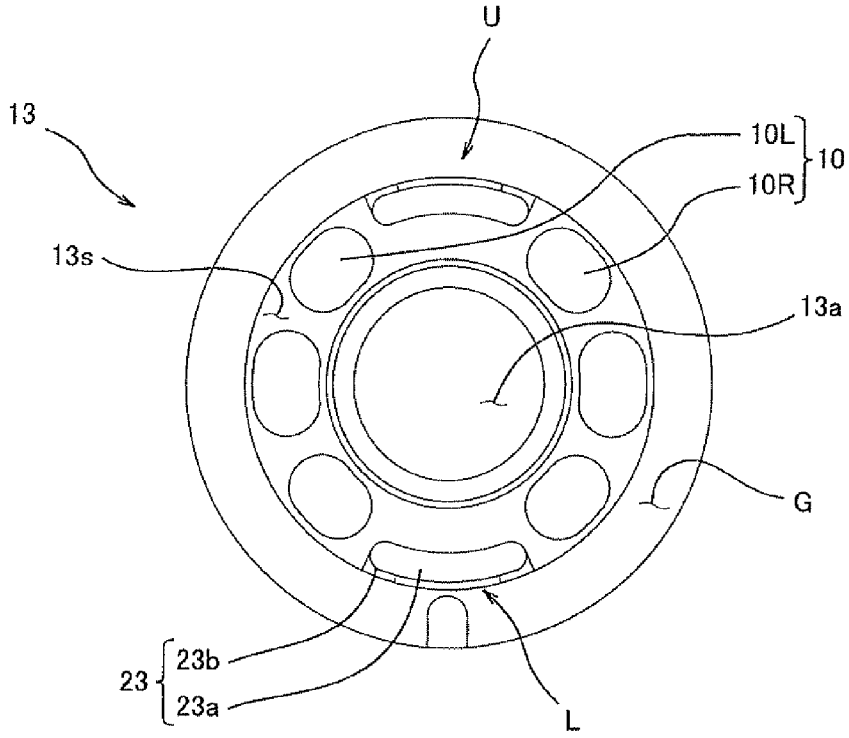
FIG. 3 is a diagram showing another reference technical example of the valve plate used in the axial piston hydraulic motor.

The concave portions 23 of the valve plate 13 of FIG. 3 are respectively formed at the upper dead center U and lower dead center L of a supporting surface 13*s*. The concave portion 23 is constituted by a circular-arc groove 23*a* formed along an outer peripheral circle of the valve plate 13 and a short radial groove 23*b* formed to cause the circular-arc groove 23*a* to communicate with the motor housing 2 located on an outer side of the valve plate 13. The circular-arc groove 23*a* is formed in the vicinity of the outer periphery of the valve plate 13. The operating oil in the low-pressure ports from the cylinders 6 flows through the operating oil supply passage 19 into the concave portion 23. Then, the operating oil flows out through the radial groove 23*b* to the housing 2.

Figure 4:
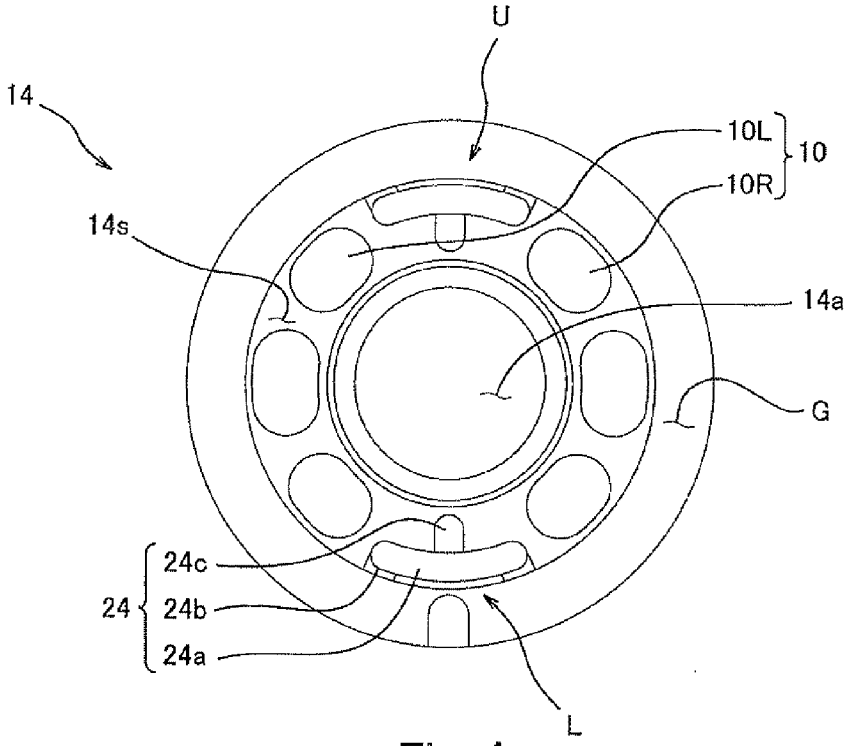
FIG. 4 is a diagram showing another reference technical example of the valve plate used in the axial piston hydraulic motor.

The concave portion 24 of the valve plate 14 of FIG. 4 is formed by adding to the concave portion 23 of FIG. 3 a second radial groove 24*c* extending toward an inner side of the valve plate 14. Since the shapes of the other portions of the concave portion 24 including a first radial groove 24*b* are the same as those of the concave portion 23 of FIG. 3, similar reference signs are used for similar components, and detailed explanations thereof are omitted. The second radial groove 24*c* extends from the center of the circular-arc groove 24*a* toward a central through hole 14*a* located on the inner side of the valve plate 14 but does not reach the central through hole 14*a*. The second radial groove 24*c* is formed for the purpose of effectively increasing the cooling area.

Figure 5:
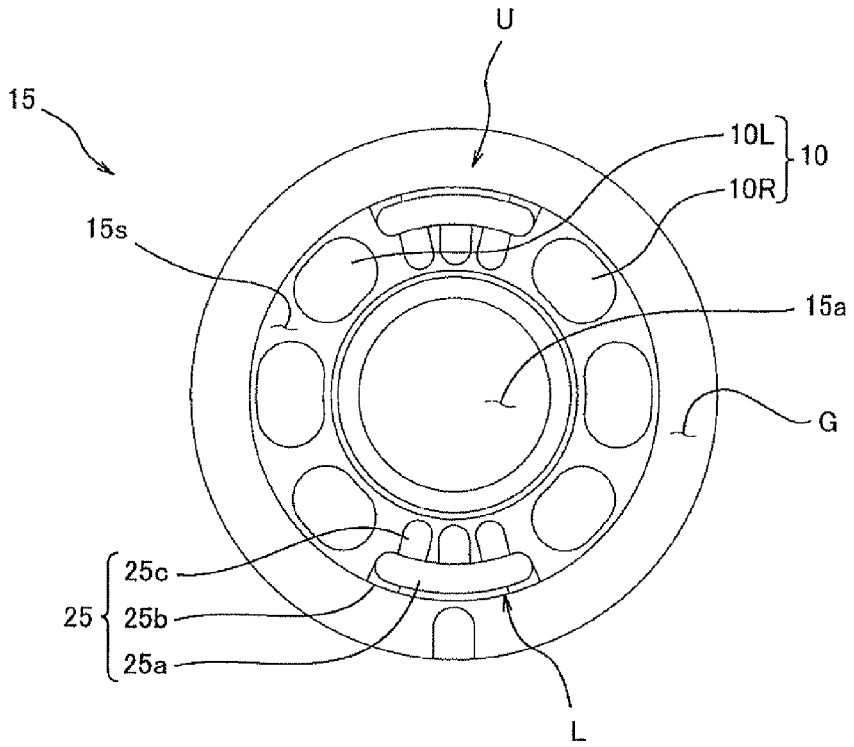
FIG. 5 is a diagram showing another reference technical example of the valve plate used in the axial piston hydraulic motor.

The concave portion 25 of the valve plate 15 of FIG. 5 is formed by adding a plurality of second radial grooves 25*c* to the concave portion 23 of FIG. 3, each of the second radial grooves 25*c* being similar to the second radial groove explained in FIG. 4. Since the shapes of the other portions, such as a circular-arc groove 25*a* and a first radial groove 25*b*, are the same as those of the concave portion of FIG. 3 or 4, similar reference signs are used for similar components, and detailed explanations thereof are omitted. The second radial grooves 25*c* do not reach a central through hole 15*a*, The second radial grooves 25*c* are formed for the purpose of effectively increasing the cooling area.

Figure 6:
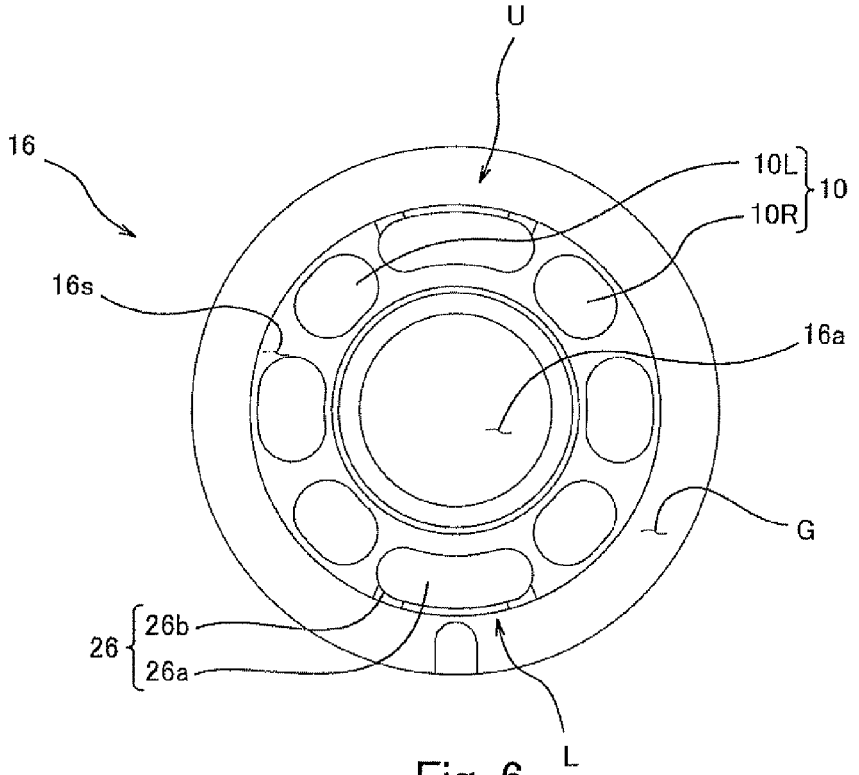
FIG. 6 is a diagram showing another reference technical example of the valve plate used in the axial piston hydraulic motor.

The concave portion 26 of the valve plate 16 of FIG. 6 is formed such that the circular-arc groove 23*a* of the concave portion 23 in FIG. 3 is increased in width. Since the shapes of the other portions, such as a radial groove 26*b*, are the same as those of the concave portion 23 of FIG. 3, similar reference signs are used for similar components, and detailed explanations thereof are omitted. The width of the circular-arc groove 26*a* is about 1.5 to 2 times the width of each of the circular-arc grooves 12*a*, 23*a*, 24*a*, and 25*a* of FIGS. 2 to 5.

Figure 7:
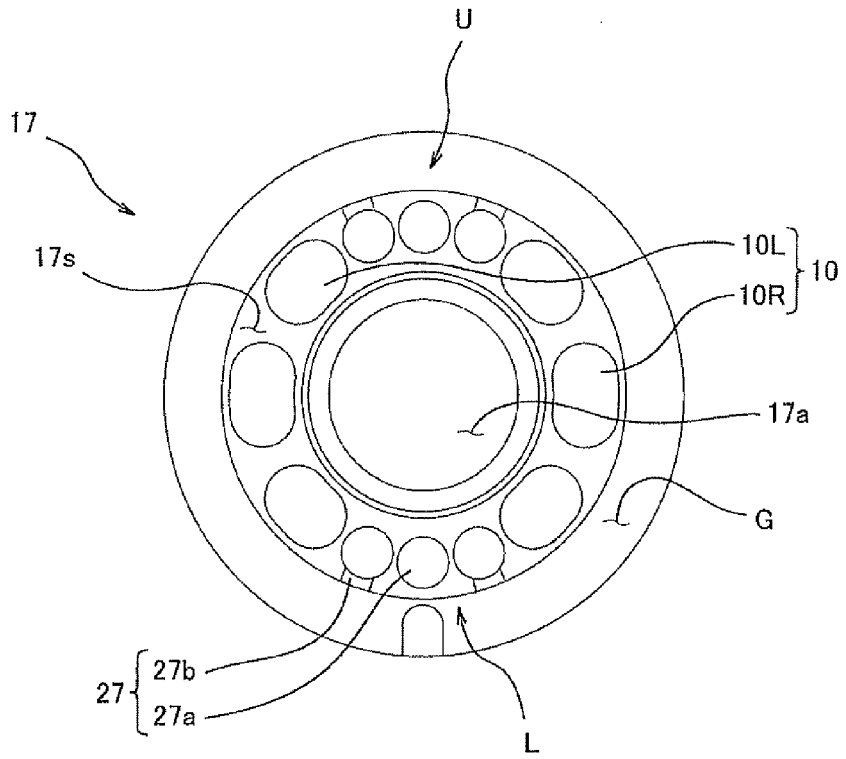
FIG. 7 is a diagram showing another reference technical example of the valve plate used in the axial piston hydraulic motor.

The concave portion 27 of the valve plate 17 of FIG. 7 is formed such that instead of the circular-arc groove 23*a* of FIG. 3, a plurality of circular concave portions 27*a* arranged along an outer peripheral circle of the valve plate 17 in the vicinity of the outer periphery of the valve plate 17 are adopted. In addition, short radial grooves 27*b* are formed for causing the circular concave portions 27*a* located on both sides to communicate with the motor housing 2 located on an outer side of the valve plate 17.

Figure 8:
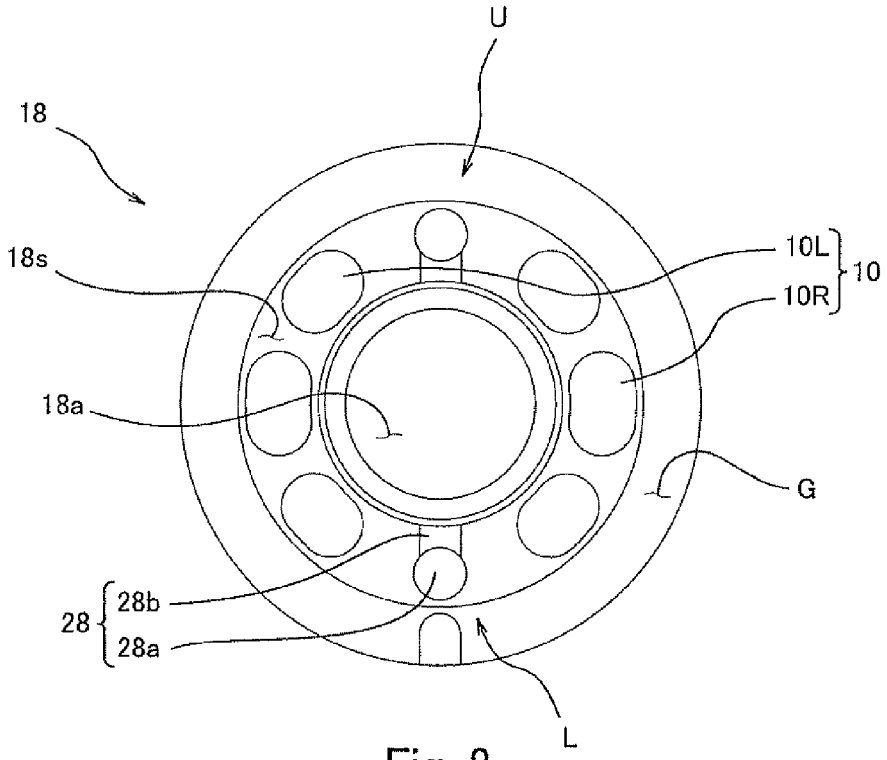
FIG. 8 is a diagram showing a reference technical example of the valve plate used in the axial piston hydraulic pump.

The concave portion 28 of the valve plate 18 of FIG. 8 is formed such that instead of a plurality of concave portions, only one concave portion 28*a* similar to the circular concave portion shown in FIG. 7 is formed at each of the upper dead center U and the lower dead center L. In addition, a short radial groove 28*b* similar to the radial groove shown in FIG. 2 extends from each of the circular concave portions 28*a* so as to communicate with a central through hole 18*a* of the valve plate 18.

The concave portions of the valve plates 5 and 13 to 18 used in the swash plate type motor are exemplified in FIGS. 2 to 8. However, the present embodiment is not limited to these. For example, the concave portion may be formed to communicate with both the motor housing 2 located on the outer side of the valve plate and the central through hole (5*a* and 13*a* to 18*a*), not one of the motor housing 2 and the central through hole (5*a* and 13*a* to 18*a*). Moreover, the concave portion may be formed only by the radial groove formed to cause the motor housing 2 located on the outer side of the valve plate and the central through hole (5*a* and 13*a* to 18*a*) to directly communicate with each other without forming the circular-arc groove. In contrast, a groove for aggressively causing the concave portion (the circular-arc groove and the radial groove) to communicate with the motor housing 2 located on the outer side of the valve plate and the central through hole (5*a* and 13*a* to 18*a*) does not have to be formed. Even in this case, the cooling effect can be obtained by the operating oil in the concave portion. In addition, the cooling effect can be obtained since a small amount of operating oil flows through an extremely narrow gap between the inner surface of the motor housing 2 and the supporting surface (5*s* and 13*s* to 18*s*) of the valve plate (5 and 13 to 18). To be specific, the cooling effect can be obtained only by forming the concave portion on the supporting surface 5*s* regardless of the shape of the concave portion.

Moreover, a dedicated passage through which the operating oil is supplied to the concave portion may be formed instead of or in addition to the configuration in which the concave portion of the valve plate (5 and 13 to 18) communicates with the motor housing 2 located on the outer side of the valve plate and/or the central through hole (5*a* and 13*a* to 18*a*). This dedicated passage is shown by a broken line in FIG. 1. To be specific, the operating oil supply passage 19 is formed to have a tunnel shape in the wall of the motor housing 2, Although not shown, the operating oil supply passage 19 is connected to the above-described low-pressure port 10L or 10R. The operating oil supply passage 19 is formed so as to always receive the operating oil from a port that becomes a discharge port by a switching valve, not shown. The cooling effect improves by aggressively supplying the operating oil to the concave portion as above.

In the valve plates 5 and 13 to 18 used in the swash plate type motor described above, unlike the below-described swash plate type pump, the cooling concave portion is not caused to communicate with the port for the purpose of increasing the cooling effect. This is because in the swash plate type motor, each of the left and right ports may alternately become a high-pressure oil supply port by the change of the rotational direction. In addition, this is because if the concave portion is caused to communicate with the oil supply port, a part of the high-pressure operating oil to be supplied to the cylinders may flow into the concave portion and this may decrease the output efficiency of the motor. Moreover, if the high-pressure operating oil flows to the back surface side of the valve plate (5 and 13 to 18), the force of separating the valve plate (5 and 13 to 18) from the motor housing 2 acts. Of course, if for example, the decrease of the output efficiency is allowed, the cooling effect may be improved by causing the cooling concave portion to communicate with the port.

Figure 9:
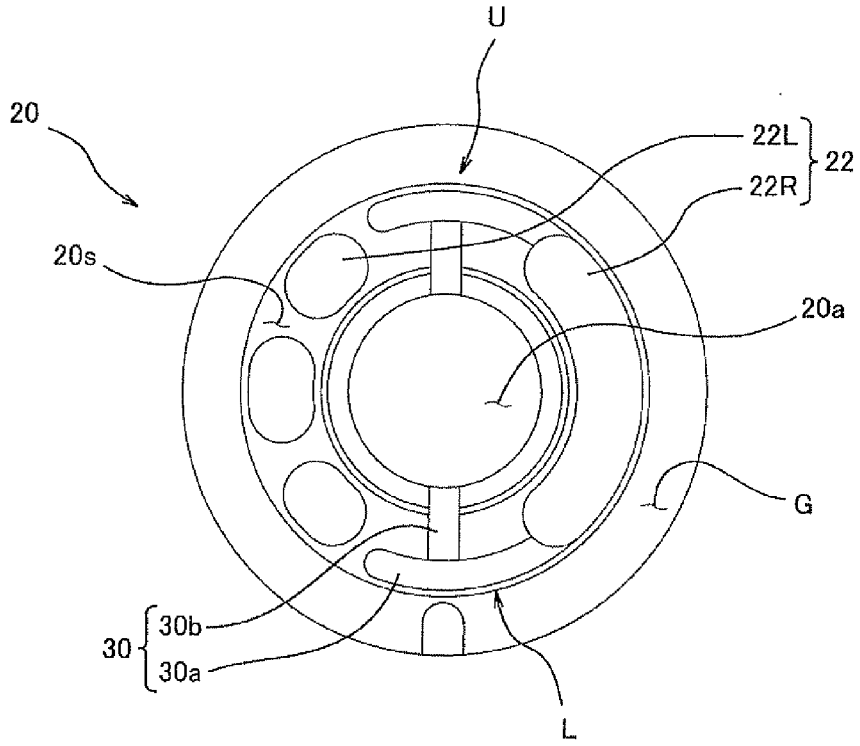
FIG. 9 is a diagram showing a valve plate according to one embodiment used in the axial piston hydraulic pump.
Figure 10:
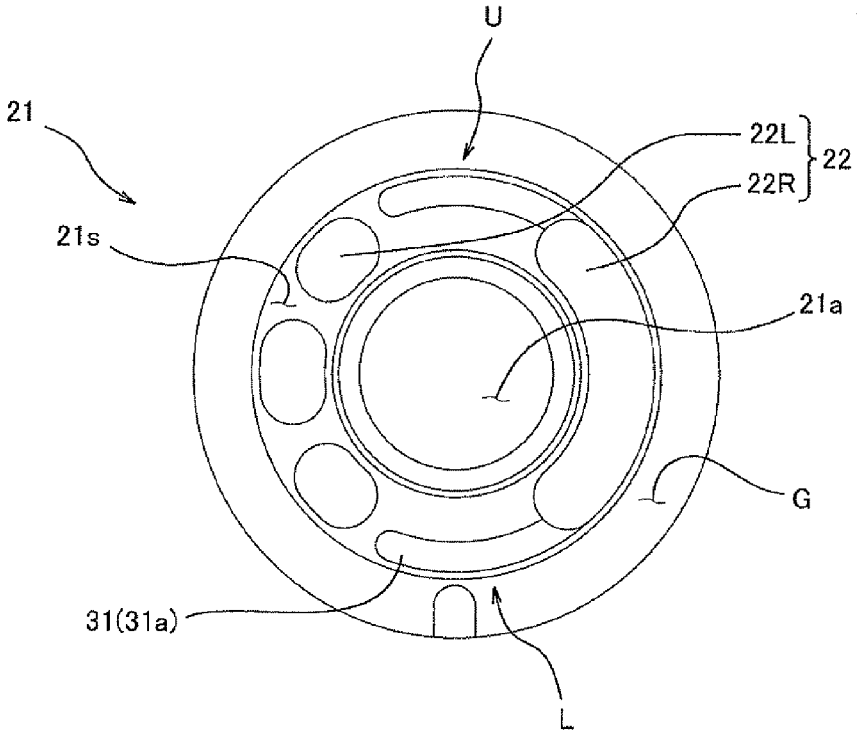
FIG. 10 is a diagram showing a reference technical example of the valve plate used in the axial piston hydraulic pump.
Figure 11:
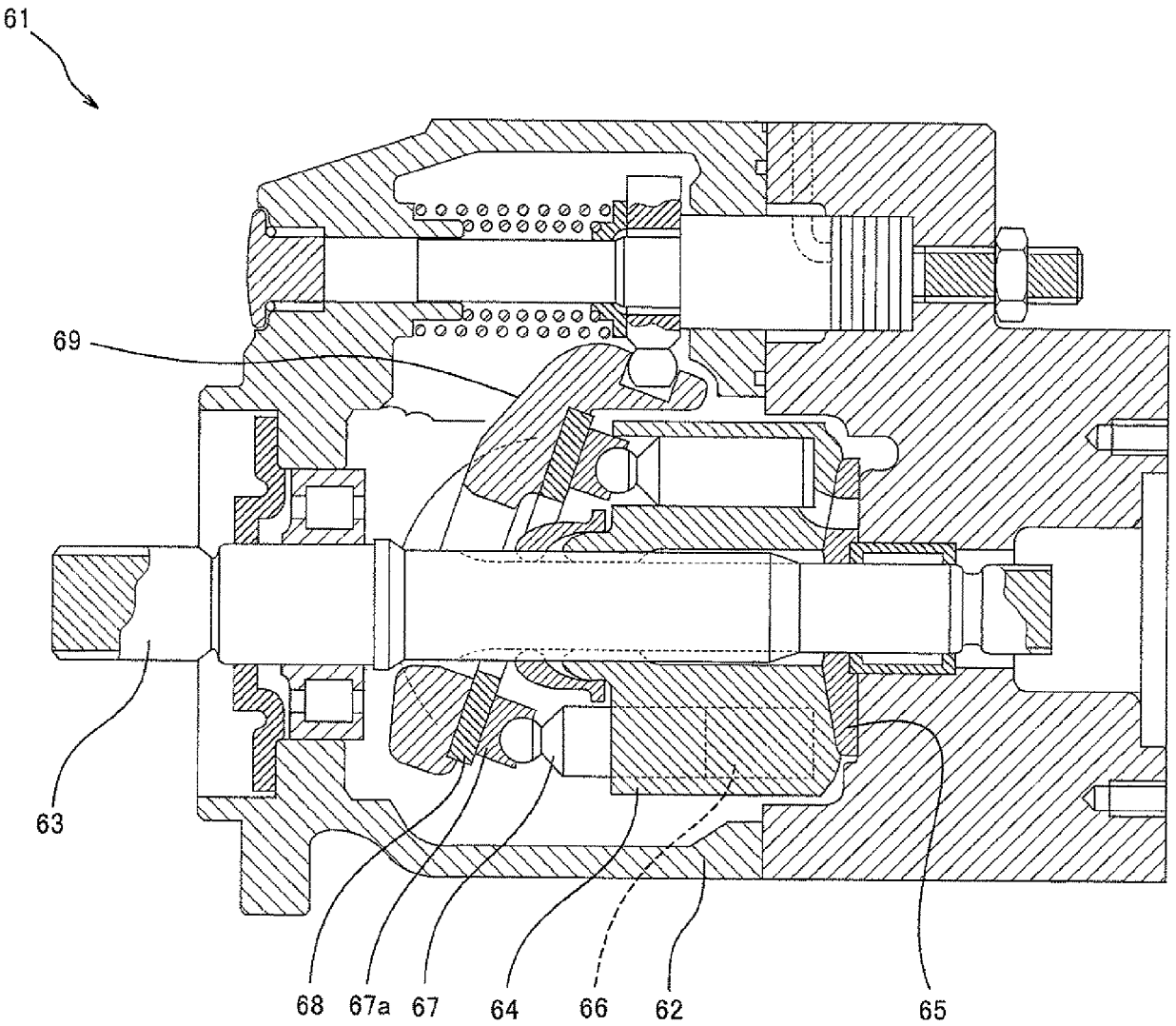
FIG. 11 is a longitudinal sectional view showing a swash plate type axial piston hydraulic pump including a conventional valve plate.

FIGS. 9 and 10 show supporting surfaces 20*s* and 21*s* of valve plates 20 and 21 used in the swash plate type pump. The configuration of the swash plate type pump is basically the same as that of the swash plate type motor. However, unlike the swash plate type motor, the shaft fixed to the center of the cylinder block in the swash plate type pump is not the motor shaft but a driving shaft. The cylinder block is rotated by rotating the driving shaft by a driving device. As a result, each piston having the spherical tip end portion coupled to the shoe 7*a* reciprocates in the cylinder. As above, the input and output of the swash plate type pump are opposite to those of the swash plate type motor. However, as with the swash plate type motor, the cylinder block of the swash plate type pump rotate in a state where the cylinder block is being pressed against the valve plate by the action of the internal pressure of the cylinders. As a result, the frictional heat is generated on the sliding surfaces of the valve plate and the cylinder block. These are explained in the Background Art of the present specification.

Operating oil suction and ejection ports 22R and 22L are formed on each of the valve plates 20 and 21 shown in FIGS. 9 and 10. One right, long, circular-arc port 22R is the suction port, and three left ports 22L are the ejection ports. The shape of the suction port 22R is different from that of the port 10R (FIGS. 2 to 8) of the swash plate type motor. This is because since the operating oil on the suction side is low in pressure, the formation of the long port 22R as shown does not cause strength problems on the valve plates 20 and 21. Here, the suction side is always the suction side, and the suction and the ejection are not reversed by changing the rotational direction of the driving shaft. On the high pressure side, a so-called bridge (a portion between the port 22L and the port 22L) is formed at the ports for the purpose of maintaining the strength of each of the valve plates 20 and 21. The cooling concave portion is formed at each of the upper dead center U and lower dead center L of each of the supporting surfaces 20*s* and 21*s* of the valve plates 20 and 21.

A concave portion 30 similar to the concave portion 12 of the valve plate 5 used in the motor shown in FIG. 2 is formed on the valve plate 20 of FIG. 9. Each of the concave portions 30 at the upper dead center U and the lower dead center L is constituted by a circular-arc groove 30*a* formed along the outer peripheral circle of the valve plate 20 in the vicinity of the outer periphery of the valve plate 20 and a radial groove

30*b* formed to cause the circular-arc groove 30*a* to communicate with a central through hole 20*a*. However, one end of the circular-arc groove 30*a* communicates with the suction port 22R. Therefore, the operating oil flows between the suction port 22R and the central through hole 20*a* through the circular-arc groove 30*a* and the radial groove 30*b*. In a case where the concave portion 30 communicates with the port 22R where the amount of flow of the operating oil is large, the cooling effect of the valve plate 20 improves as compared to a case where the concave portion 30 communicates with only the motor housing 2 located on an outer side of the valve plate 20 and the central through hole 20*a*. Moreover, the reason why the circular-arc groove 30*a* communicates with not the ejection port 22L but the suction port 22R is because the pump efficiency decreases in a case where the circular-arc groove 30*a* communicates with the ejection port 22L.

A concave portion 31 of the valve plate 21 shown in FIG. 10 is constituted only by a circular-arc groove 31*a* formed to communicate with the suction port 22R.

The concave portions 30 and 31 of the valve plates 20 and 21 used in the swash plate type pump are exemplified only in FIGS. 9 and 10. However, the present embodiment is not limited to this. For example, each of the concave portions 12 and 23 to 28 of the valve plates 5 and 13 to 18 used in the swash plate type motor shown in FIGS. 2 to 8 may be adopted as it is. Or, the concave portion formed by causing the circular-arc groove 23*a*, 24*a*, 25*a*, or 26*a* shown in FIG. 3, 4, 5, or 6 to communicate with the suction port 22R may be adopted. Or, the concave portion formed by causing the second radial groove 24*c* or 25*c* shown in FIG. 4 or 5 to communicate with the suction port 22R may be adopted. Or, the concave portion formed by causing the circular concave portion 27*a* or 28*a* shown in FIG. 7 or 8 to communicate with the suction port 22R may be adopted.

In the embodiment explained above, the swash plate type motor and the swash plate type pump are used as examples. However, the present embodiment is not limited to these. For example, the present invention is applicable to the bent axis type hydraulic motor and the bent axis type hydraulic pump.

INDUSTRIAL APPLICABILITY

According to the present invention, the valve plate can be effectively cooled without depending on the adjustment of the amount of leakage oil. Therefore, the present invention is especially useful for the hydraulic motor and the hydraulic pump in which the further increase in the revolution and the further increase in the pressure of the operating oil are required.

REFERENCE SIGNS LIST

1 swash plate type motor
2 motor housing
3 cylinder block
4 motor shaft
5 valve plate
6 cylinder
7 piston
7*a* shoe
8 retainer plate
9 swash plate
9*a* shoe plate
10 port
11 whirl-stop pin
12 concave portion
13 to 18 valve plate
19 operating oil supply passage
20, 21 valve plate
22 port
23 to 28 concave portion
30, 31 concave portion
CL central axis (of cylinder block)
G (gap on back surface of valve plate)

The invention claimed is:

1. A valve plate used in an axial piston hydraulic pump including a rotating shaft and a rotary cylinder block in a housing, the valve plate comprising:

a sliding supporting surface configured to contact a rear end surface of the cylinder block to support the cylinder block;

a back surface corresponding to and opposite to the sliding supporting surface;

a central hole through which the rotating shaft penetrates;

a plurality of ports formed around the central hole as inlets and outlets for operating oil so as to penetrate the valve plate;

a cooling concave portion formed on the back surface;

a first groove through which the operating oil flows, the first groove being configured to communicate with the cooling concave portion and at least one of either: (i) the central hole located on an inner side of the valve plate, or (ii) an inner space of the housing formed on the back surface and located on an outer side of the valve plate; and a second groove formed on the back surface through which the operating oil flows, the second groove being configured to communicate with the cooling concave portion and an operation oil suction port that is one of the plurality of ports.

2. A valve plate used in an axial piston hydraulic motor including a rotating shaft and a rotary cylinder block in a housing, the valve plate comprising:

a sliding supporting surface configured to contact a rear end surface of the cylinder block to support the cylinder block;

a back surface corresponding to and opposite to the sliding supporting surface;

a central hole through which the rotating shaft penetrates;

a plurality of ports formed around the central hole as inlets and outlets for operating oil so as to penetrate the valve plate;

a cooling concave portion formed on the back surface;

a first groove through which the operating oil flows, the first groove being configured to communicate with the cooling concave portion and at least one of either: (i) the central hole located on an inner side of the valve plate, or (ii) an inner space of the housing formed on the back surface and located on an outer side of the valve plate; and an operating oil supply passage formed on the back surface through which the operating oil flows, the operating oil supply passage being configured to communicate with the cooling concave portion and an operating oil discharge port that is one of the plurality of ports.

3. An axial piston hydraulic pump comprising a valve plate, wherein:

the valve plate is the valve plate according to claim 1;

the rotating shaft is a driving shaft configured to cause the cylinder block to rotate; and the plurality of ports are suction ports and ejections ports for the operating oil.

4. An axial piston hydraulic motor comprising a valve plate, wherein:

the valve plate is the valve plate according to claim 2;

the rotating shaft is a motor shaft configured to be rotated by rotation of the cylinder block; and the plurality of ports are supply ports and discharge ports for the operating oil, the supply ports and the discharge ports being alternately switched by switching a rotational direction of the motor.

* * * * *